United States Patent [19]

Ando et al.

[11] Patent Number: 4,726,344

[45] Date of Patent: Feb. 23, 1988

[54] ELECTRONIC AIR-FUEL MIXTURE CONTROL SYSTEM FOR INTERNAL COMBUSTION ENGINE

[75] Inventors: Tsuneo Ando; Kazusato Kasuya; Yukitoshi Asada; Hironobu Sugimoto, all of Oobu, Japan

[73] Assignee: Aisan Kogyo Kabushiki Kaisha, Oobu, Japan

[21] Appl. No.: 820,149

[22] Filed: Jan. 21, 1986

[30] Foreign Application Priority Data

Jan. 21, 1985 [JP] Japan ..... 60-8616

[51] Int. Cl.[4] ..... F02D 41/14

[52] U.S. Cl. ..... 123/440; 123/489

[58] Field of Search ..... 123/440, 489

[56] References Cited

U.S. PATENT DOCUMENTS 4,517,948 5/1985 Kaji et al. ..... 123/489

4,566,420 1/1986 Sakamoto et al. ..... 123/489

FOREIGN PATENT DOCUMENTS 150057 9/1983 Japan .

*Primary Examiner*—Tony M. Argenbright

*Attorney, Agent, or Firm*—Oblon, Fisher, Spivak, McClelland & Maier

[57] ABSTRACT

An electronic air-fuel mixture control system is adapted to an internal combustion engine to determine an optimum air-fuel ratio in dependence upon renewal of a plurality of learning values related to a plurality of load regions of the engine. The control system is arranged to conduct simultaneous learning of the learning values at a frequency in accordance with lapse of time and to conduct selective learning of the learning values in accordance with change of the load acting on the engine.

6 Claims, 15 Drawing Figures

ELECTRONIC AIR-FUEL MIXTURE CONTROL SYSTEM FOR INTERNAL COMBUSTION ENGINE

BACKGROUND OF THE INVENTION

1. Field of the Invention

The present invention relates to an electronic air-fuel mixture control system for internal combustion engines, more particularly to an electronic air-fuel mixture control system for determining an optimum air-fuel ratio in dependence upon learning values renewed in response to change of the load acting on the engine.

2. Discussion of the background

Such an electronic air-fuel mixture control system as described above has been proposed in the Japanese Patent Early Publication No. 58-150057, wherein a plurality of learning values related to a plurality of load regions are selectively renewed in response to change of the load acting on the engine so as to determine an optimum air-fuel ratio in dependence upon the renewed learning value. In such selective learning of the learning values, it is, however, observed that the learning values are only partially renewed when the engine load is frequently detected in a limited load region. For this reason, it is unable to quickly conduct uniform learning of the plural learning values in response to change of the engine load. This results in difficulty in reliable determination of the optimum air-fuel ratio for various operations of the engine.

SUMMARY OF THE INVENTION

It is, therefore, a primary object of the present invention to provide an improved electronic air-fuel mixture control system capable of quickly conducting uniform learning of the plural learning values even when the engine load is frequently detected in a limited load region.

Another object of the present invention is to provide an improved electronic air-fuel mixture control system, having the foregoing characteristics, capable of determining the optimum air-fuel ratio for various operation of the engine in a reliable manner.

According to the present invention briefly summarized, there is provided an electronic air-fuel mixture control system which comprises first detecting means for producing a first signal indicative of the load acting on the engine, second detecting means for producing a second signal indicative of parameters of the engine such as intake manifold pressure, air temperature, engine speed, cooling water temperature, oxygen concentration in exhause gases and the like, first learning means for simultaneously learning a plurality of learning values related to a plurality of load regions of the engine, second learning means responsive to the first signal for selectively learning the plural learning values in accordance with the engine load, means for repeatedly conducting the simultaneous learning of all the learning values allowable learning times determined in relation to lapse of time and for subsequently conducting the selective learning of the learning values after finish of the simultaneous learning, means responsive to the first signal for selecting one of the load regions in accordance with the engine load and for selecting one of the learning values related to the selected load region, means responsive to the second signal for determining an amount of fuel for an optimum air-fuel ratio in accordance with the engine parameters and the selected learning value, and means for producing an output signal indicative of the deteremined amount of fuel to apply it to a fuel supply control device for the engine.

BRIEF DESCRIPTION OF THE DRAWINGS

Additional objects and advantages of the present invention will become more readily apparent from the following detailed description of preferred embodiments thereof when taken together with the accompanying drawings, in which.

DETAILED DESCRIPTION OF THE PREFERRED EMBODIMENTS

Figure 1:
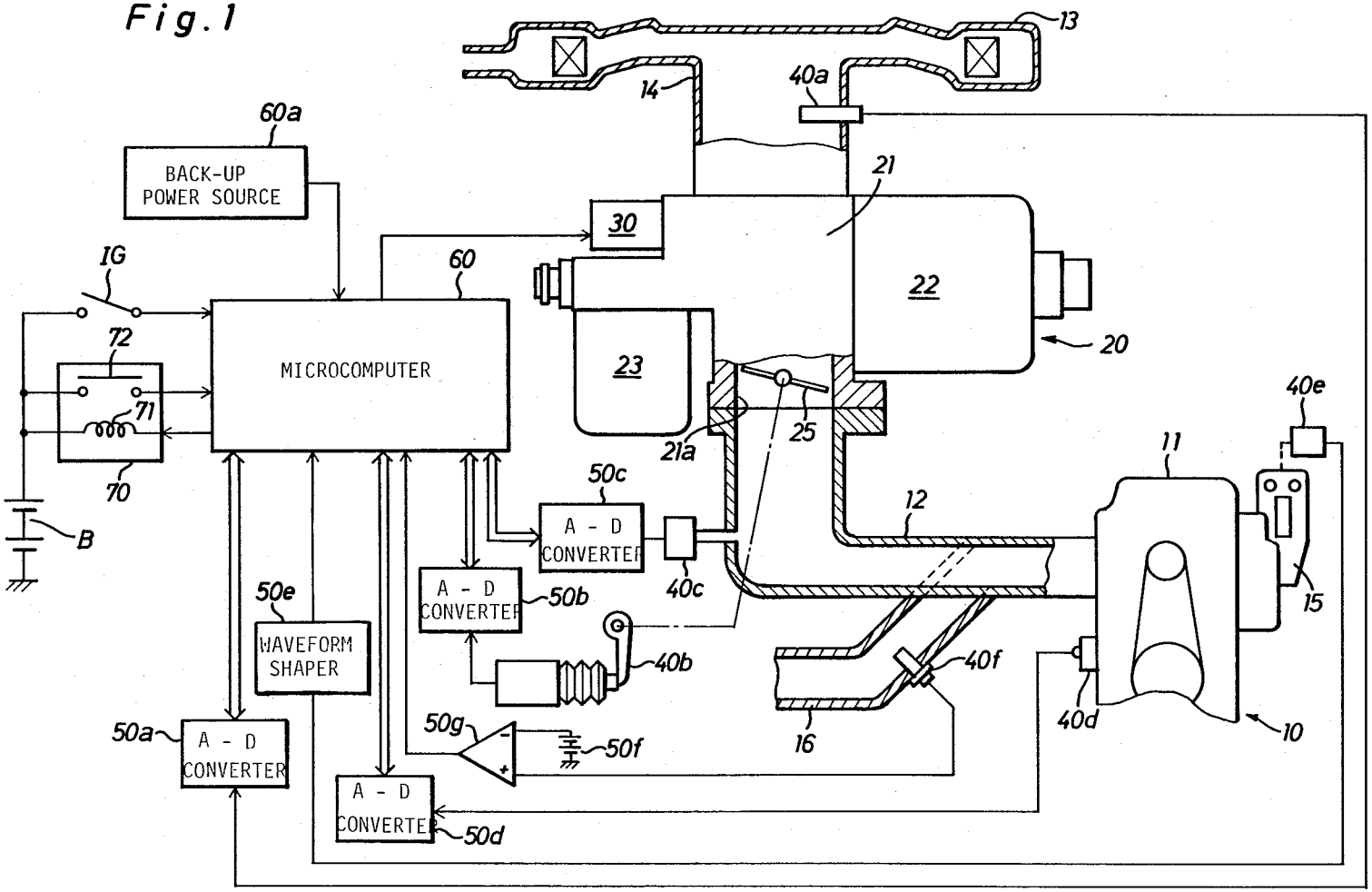
FIG. 1 is a schenatic block diagram of an electronic air-fuel mixture control system for an internal combustion engine in accordance with the present invention.
Figure 2:
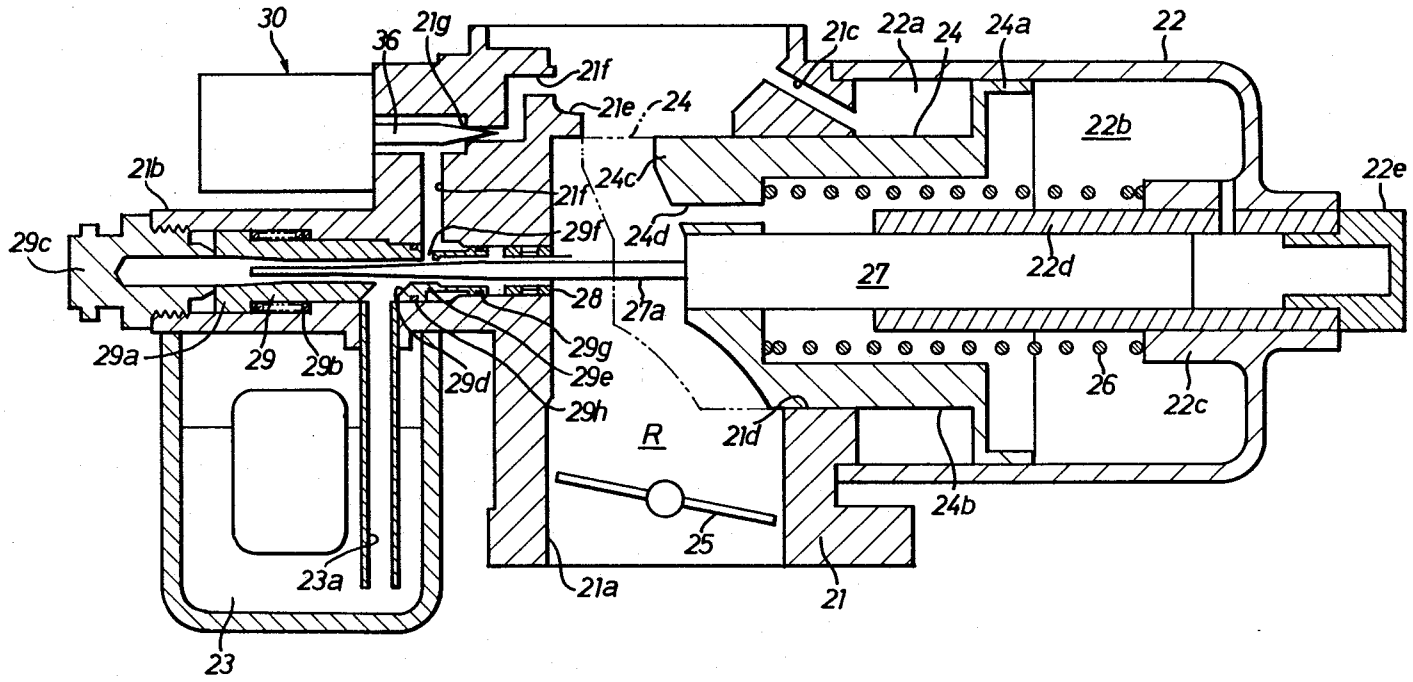
FIG. 2 is a sectional view of a carburetor adapted to the engine shown in FIG. 1.

Referring now to the drawings and particularly to FIG. 1, there is illustrated an electronic air-fuel mixture control system adapted to a carburetor 20 for an internal combustion engine 10. The carburetor 20 comprises a carburetor body 21 which is interposed between an intake manifold 12 connected with a cylinder block 11 of engine 10 and an air duct 14 provided thereon with an air cleaner 13. As shown in FIG. 2, the carburetor body 21 is formed therein with an induction or intake conduit 21*a* which contains, upstream of a main throttle valve 25 operated by the driver, an auxiliary throttle element 24. The auxiliary throttle element 24 is in the form of a spring loaded throttle piston 24 arranged to form a mixing chamber R defined by the main throttle valve 25 and the throttle piston 24. The throttle piston 24 has a small diameter portion 24*b* axially slidably supported at 21*d* on a peripheral wall of the carburetor body 21 and has a head portion 24*c* which cooperates with an internally protruded portion 21*e* of carburetor body 21 to provide a variable venturi for controlling the flow of air into the intake conduit 21*a*. A hollow cylindrical casing 22 is hermetically fixed to the peripheral wall of carburetor body 21 to contain therein a cylindrical large diameter portion 24*a* of piston 24. The interior of casing 22 is subdivided by the large diameter portion 24*a* of piston 24 into an atmospheric chamber 22*a* and a vacuum chamber 22*b* which are respectively in open communication with the atmosphere through an air passage 21c in the peripheral wall of body 21 upstream of the throttle piston 24 and in open communication with the mixing chamber R through a suction passage 24d in piston 24. A guide rod 27 is fixed to the head portion 24c of throttle piston 24 and axially slidably supported by a guide sleeve 22d which is fixedly mounted at its outer end on the cylindrical casing 22. The guide sleeve 22d is arranged coaxially with the throttle piston 24 and is closed by a closure plug 22e secured thereto. A compression coil spring 26 in surrounding relationship with the guide sleeve 22d is engaged at one end thereof with an annular inner wall 22c of casing 22 to bias the throttle piston 24 toward the internally protruded portion 21e of carburetor body 21.

The carburetor body 21 is formed at one side thereof with a cylindrical portion 21b which is arranged coaxially with the throttle piston 24 to contain therein a needle valve element 27a extending from the inner end of throttle piston 24. A cylindrical nozzle 28 is fixedly coupled within a stepped bore of cylindrical portion 21b and arranged in surrounding relationship with the needle valve element 27a. A stepped sleeve 29 is disposed within the stepped bore of the cylindrical portion 21b of carburetor body 21 through axially spaced sealing members 29g and 29h. The sleeve 29 is loaded by a compression coil spring 29b outwardly and engaged at its outer end 29a with the inner end of a closure plug 29c threaded into the cylindrical portion 21b. The sleeve 29 is formed at its intermediate portion with a radial hole 29d which is connected to a float chamber 23 through a vertical fuel pipe 23a. The inner end portion of sleeve 29 is formed therein with an annular metering jet 29e which cooperates with the needle valve element 27a to control the amount of fuel flowing therethrough. The inner end portion of sleeve 29 is further formed with a radial air hole 29f which connects the metering jet 29e to the upstream of internally protruded portion 21e through an air bleed passage 21f. Thus, fuel in the float chamber 23 is fed into the interior of sleeve 29 through the vertical fuel pipe 23a and mixed with the air from air bleed passage 21f. The air-fuel mixture is fed into the mixing chamber R through the nozzle 28 after it is metered by an annular gap between the needle valve element 27a and the metering jet 29e.

Figure 3:
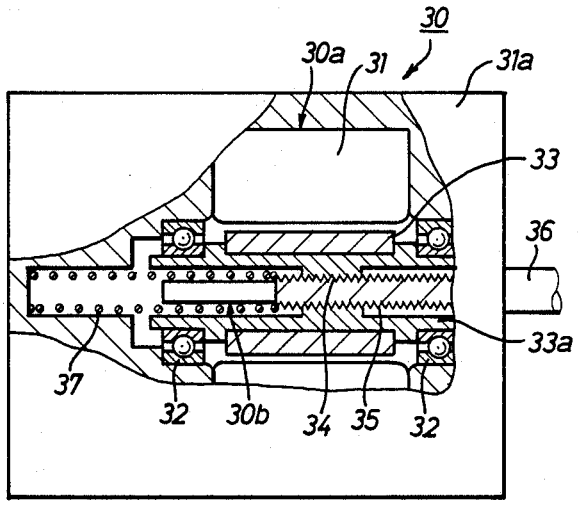
FIG. 3 is a partially sectioned view of an electric drive mechanism adapted to the carburetor shown in FIG. 2.

The carburetor 20 is provided with an electric drive mechanism 30 which is attached to the peripheral wall of carburetor body 21. As shown in FIG. 3, the drive mechanism 30 includes a stepper motor 30a and an axially displaceable plunger 30b. The stepper motor 30a comprises a stator 31a secured to an end wall of carburetor body 21 at a place adjacent the air bleed passage 21f, and an annular field winding 31 mounted within the stator 31a in surrounding relationship with a cylindrical rotor 33 which is fixed to a hollow shaft 33a. The hollow shaft 33a is rotatably supported by a pair of axially spaced ball bearings 32, 32 carried on the stator 31a. The plunger 30b has a male screw portion 35 threadedly engaged with a female screw portion 34 formed in the inner periphery of hollow shaft 33a, and a needle valve element 36 extending into the air bleed passage 21f from the male screw portion 35. The plunger 30b is guided by an internal portion of the stator 31a in such a manner as to be axially displaceable but not rotatable about its axis. The plunger 30b is loaded by a compression coil spring 37 toward the air bleed passage 21f. The needle valve element 36 is arranged to cooperate with an annular valve seat 21g in the air bleed passage 21f for controlling the amount of air flowing from the upstream of passage 21f into the metering jet 29e. In the above arrangement, axial displacement of the needle valve element 36 is effected by rotation of the rotor 33 caused by activation of the stepper motor 30a.

As shown in FIG. 1, the electronic air-fuel mixture control system for the carburetor 20 comprises analog-to-digital or A-D converters 50a, 50b, 50c and 50d each connected to an air temperature sensor 40a, a throttle position sensor 40b, a negative pressure sensor 40c and a cooling water temperature sensor 40d; a waveform shaper 50e connected to a rotational angle sensor 40e; and a comparator 50g connected to the cooling water temperature sensor 40e and a standard signal generator 50f. The air temperature sensor 40a is disposed within the air duct 14 to detect a temperature of air flow in the duct 14 for producing an analog signal indicative of the air temperature. The throttle position sensor 40b is operatively connected to the main throttle valve 25 to detect the opening degree of throttle valve 25 for producing an analog signal indicative of the opening degree of throttle valve 25. The negative pressure sensor 40c is arranged to detect a negative pressure in the intake manifold 12 for producing an analog signal indicative of the intake manifold negative pressure. The cooling water temperature sensor 40d is arranged to detect a temperature of water in the cooling system of the engine 10 for producing an analog signal indicative of the cooling water temperature. The rotational angle sensor 40e is arranged to detect a rotational angle of a cam member in a distributor 15 attached to the engine 10 for producing an angular signal indicative of the rotational angle of the engine 10. An exhaust gas oxygen sensor 40f is arranged to detect concentration of the oxygen in exhaust gases flowing through an exhaust pipe 16 of the engine for producing an analog signal indicative of the oxygen concentration in the exhaust gases.

The A-D converters 50a–50d each are applied with the analog signals from the sensors 40a–40d to convert them into digital signals respectively indicative of the air temperature, the opening degree of throttle valve 25, the intake manifold negative pressure, and the cooling water temperature. The waveform shaper 50e is applied with the angular signal from the rotational angle sensor 40e to reform it into a rectangular wave signal indicative of the rotational angle of the engine 10. The standard signal generator 50f is arranged to produce a standard signal indicative of a predetermined oxygen concentration for a stoichiometric air-fuel ratio. The comparator 50g is arranged to compare the analog signal from the exhaust gas oxygen sensor 40f with the standard signal from signal generator 50f thereby to produce a high level signal when the level of the analog signal is higher than that of the standard signal and to produce a low level signal when the level of the analog signal is lower than that of the standard signal. The high level signal from the comparator 50g represents the fact that the concentration of the air-fuel mixture is higher than that defined by the stoichiometric air-fuel ratio, and the low level signal represents the fact that the concentration of the air-fuel mixture is lower than that defined by the stoichiometric air-fuel ratio.

In the electronic air-fuel mixture control system, a microcomputer 60 is adapted to cooperate with the A-D converters 50a–50d, waveform shaper 50e and comparator 50g thereby to execute various calculations for control of the stepper motor 30a on a basis of a main control program and first and second interruption control programs respectively illustrated in FIGS. 4–9 and 11. The computer 60 is connected to a DC voltage source in the form of a vehicle battery B through an ignition switch IG to be activated by closing the ignition switch IG. The computer 60 is further connected to a back-up power source 60*a* and includes therein a back-up random access memory or RAM arranged to be maintained in its activated condition by power supply from the back-up power source 60*a*, and a timer arranged to initiate the execution of the first interruption control program at a predetermined time interval, for instance, one second interval. The computer 60 is further arranged to initiate the execution of the second interruption control program in response to opening the ignition switch IG. A relay 70 is interposed between the DC voltage source B and the computer 60, which relay 70 includes an electromagnetic coil 71 and a normally open switch 72 to be closed by energization of the electromagnetic coil 71.

Hereinafter, the mode of operation of carburetor 20 under control of the computer 60 will be described in detail. Under inoperative condition of the engine 10, the main throttle valve 25 is positioned in its minimum opening position, the auxiliary throttle piston 24 is located in its maximum stroke end to fully close the intake conduit 21*a*, and the needle valve element 36 of drive mechanism 30 is positioned to fully close the air bleed passage 21*f*. Assuming that the ignition switch IG is closed to start the engine 10, the level of vacuum in the mixing chamber R increases in response to operation of the engine, and in turn, the level of vacuum in the vacuum chamber 22*b* increases to cause axial displacement of the throttle piston 24 against the compression coil spring 26. Thus, the air is drawn from the air cleaner 13 into the mixing chamber R and is mixed with the fuel drawn into the mixing chamber R from the metering jet 29*e* through the nozzle 28. In this instance, the amount of air is controlled by the axial displacement of throttle piston 24, and the amount of fuel is controlled by the axial displacement of needle valve element 27*a*. The air-fuel mixture formed in such a condition is supplied into the internal combustion engine 10 through the main throttle valve 25 and intake manifold 12.

Figure 4:
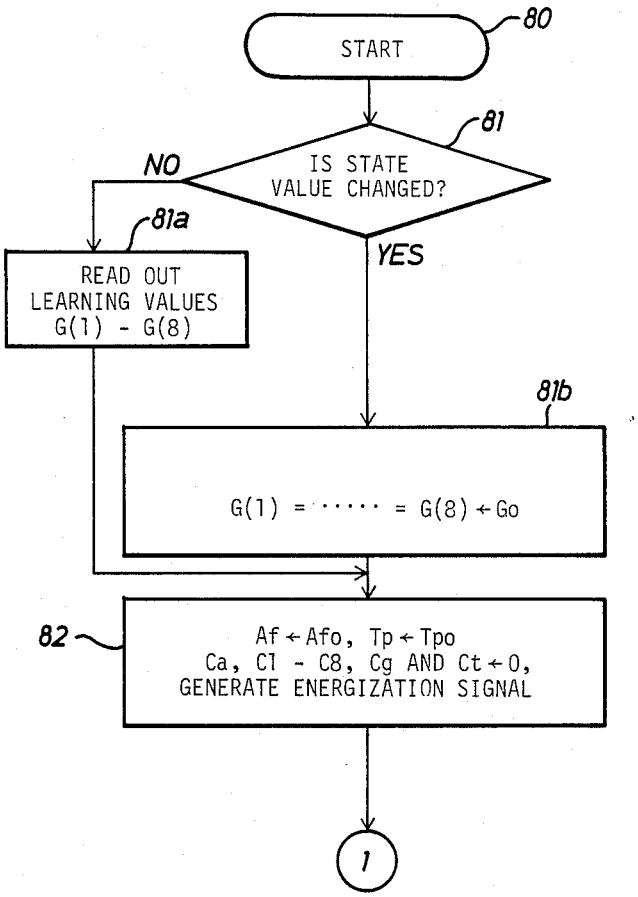
FIGS. 4 and 5 illustrate a flow chart of a main control program for the system shown in FIG. 1.
Figure 11:
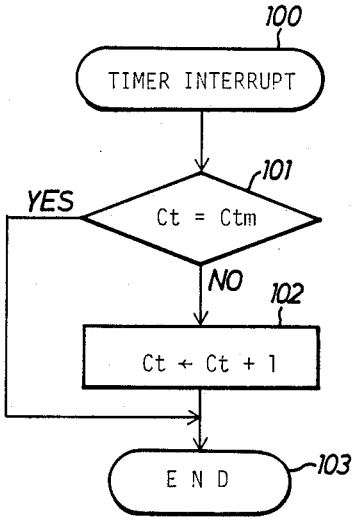
FIG. 11 is a flow chart illustrating a first interruption control program.

In the above-described condition, the microcomputer 60 is activated in response to closing of the ignition switch IG to initiate execution of the main control program at its step 80 shown in FIG. 4, and simultaneously the timer of computer 60 starts to measure the predetermined time for execution of the first interruption control program shown in FIG. 11. When the main control program proceeds to the following step 81, the computer 60 determines as to whether a state value F memorized in the RAM prior to closing of the ignition switch IG is changed at this stage or not. If the answer is "No", the program proceeds to step 81*a* where the computer 60 reads out learning values G(1)–G(8) memorized in the RAM prior to closing of the ignition switch IG. If the answer is "Yes", the program proceeds to step 81*b* where the computer 60 sets each of the learning values G(1)–G(8) as a standard learning value Go. In the present invention, the learning values G(1)–G(8) each are determined as a compensation value for correcting the actual rotary step number S of motor 30*a* to the optimum rotary step number So. In this case, the learning values G(1)–G(8) each may correspond with a first air amount region ($0 \leqq Q < Q_1$), a second air amount region ($Q_1 \leqq Q < Q_2$), . . . , and an eighth air amount region ($Q_7 \leqq Q < Q_8$), wherein the first to eighth air amount regions are respectively determined by first to eighth divided ranges of the opening degree of throttle valve 25 from its minimum opening position to its maximum opening position. The optimum rotary step number So of motor 30*a* may correspond with an optimum amount of air flowing into the metering jet 29*e* through the air bleed passage 21*f*. The standard learning value Go may correspond with an average of the minimum and maximum values of the respective learning values G(1)–G(8).

After execution at the step 81*a* or 81*b*, the program proceeds to step 32 where the computer 60 acts to set a feedback correction value Af as a standard correction value Afo and to set a learning time allowable value Tp as an initial allowable value Tpo. At step 82, the computer 60 further acts to set count values Ca, $C_1$, $C_2$ . . . , $C_8$, Cg and Ct as zero and to produce an energization signal for the electromagnetic coil 71 of relay 70. In the present invention, the feedback correction value Af is determined as a value for correcting the actual rotary step number of motor 30*a* to the optimum rotary step number So in consideration with oxygen concentration in exhaust gases, the standard correction value Afo may correspond with an optimum rotary step number defined by the stoichiometric air-fuel ratio, and the learning time allowable value Tp represents an allowable value for simultaneous learning times of the whole learning values G(1)–G(8).

When applied with the energization signal from the computer 60, the electromagnetic coil 71 is energized to close the switch 72 thereby to hold the power supply from DC voltage source B to the computer 60 through the switch 72. Subsequently, the computer 60 causes the main control program to proceed to step 83 shown in FIG. 5. At step 83, the computer 60 cooperates with the waveform shaper 50*e* and A-D converter 50*c* to calculate an amount Q of the air flow in response to the number of the rectangular wave signals and the digital signal indicative of the intake manifold pressure on a basis of the following equation.

$$Q = K \cdot P \cdot N \tag{1}$$

where K is a proportional constant, P is an absolute intake manifold pressure, and N is rotational speed of the engine 10. Thus, the computer 60 selects one of the air amount regions which corresponds with the calculated amount Q of the air flow and selects one of the learning values G(1)–G(8) which corresponds with the selected air amount region.

When the main control program proceeds to step 84, the computer 60 cooperates with the A-D converters 50*a*–50*d*, waveform shaper 50*e* and comparator 50*g* to calculate the optimum rotary step number So of motor 30*a* in response to the digital signals respectively indicative of the air temperature, the opening degree of throttle valve 25, the intake manifold negative pressure and the cooling water temperature, the rectangular wave signal indicative of the rotational angle of engine 10, and the high or low level signal indicative of the air-fuel ratio. In this instance, the calculation of the optimum rotary step number So is carried out on a basis of the following equation.

$$So = Sb + G(i) + Af + Aw + Aa + Ap \tag{2}$$

where

Sb is a standard rotary step number of motor 30a for permitting a standard amount of air flowing through the air bleed passage 21f;

G(i) is the selected learning value;

Aw is a compensation value for correcting the actual rotary step number S of motor 30a to the optimum rotary step number So in consideration with the cooling water temperature;

Aa is a compensation value for correcting the actual rotary step number S of motor 30a to the optimum rotary step number So in consideration with the air temperature; and Ap is a compensation value for correcting the actual rotary step number S of motor 30a to the optimum rotary step number So in consideration with the absolute intake manifold pressure.

During the above execution of the program at step 84, the computer 60 calculates the rotational speed N of the engine 10 in response to the rectangular wave signals from waveform shaper 50e and subsequently calculates the standard rotary step number Sb in accordance with the calculated rotational speed N and the value of the digital signal indicative of the intake manifold pressure on a basis of a standard map representing a relationship among the rotational speed N, the intake manifold pressure and the standard rotary step number Sb. The computer 60 further calculates the compensation values Aw, Aa and Ap in response to the digital signals respectively indicative of the cooling water temperature, the air temperature and the intake manifold pressure and finally calculates the optimum rotary step number So based on an addition of the calculated values Sb, Aw, Aa, Ap, the selected learning value G(i), and the standard correction value Afo.

After the above calculation, the computer 60 causes the program to proceed to step 84a. At this step 84a, the computer 60 produces a rotation signal the value of which represents a difference between the optimum rotary step number So and the actual rotary step number S. In this instance, the actual rotary step number S=0 means that the plunger 30b of drive mechanism 30 is in an initial position where the needle value element 36 cooperates with the annular valve seat 21g to fully close the air bleed passage 21f. It is, therefore, noted that an increase of the actual rotary step number S corresponds with an increase of the axial displacement of needle valve element 36 against the coil spring 37. When applied with the rotation signal from the computer 60, the motor 30a of drive mechanism 30 is activated to rotate the rotor 33 in a forward direction in accordance with the value of the rotation signal thereby to cause axial displacement of the needle valve element 36 against the coil spring 37. This results in increase of the cross-section of the gap for the air bleed passage 21f. Thus, the amount of air flowing into the metering jet 29e through the air bleed passage 21f is controlled in accordance with the axial displacement of needle valve element 36.

Subsequently, the main control program proceeds to step 85 where the computer 60 cooperates with the A-D converters 50b–50d and comparator 50g to determine as to whether a condition for feedback control of the air-fuel ratio is satisfied or not. If the answer is "Yes", the program will proceed to step 85a where the computer 60 cooperates with the A-D converter 50b and comparator 50g to calculate a compensation value Af for feedback in response to the digital signal indicative of the opening degree of throttle valve 25 and the high or low level signal indicative of the actual air-fuel ratio. If the answer is "No", the computer 60 will repeat the calculation at steps 83 and 84 to produce the rotation signal at step 84a and to determine the condition for feedback control.

When the main control program proceeds to step 86, the computer 60 cooperates with the A-D converter 50d to determine as to whether or not the value of the digital signal indicative of the cooling water temperature Tw is in excess of a value indicative of a condition for warming up of the engine 10. If the answer is "Yes", the program will proceed to step 87 where the computer 60 determines as to whether or not the count value Cg=0 is smaller than the learning time allowable value Tp=Tpo. At this stage, the computer 60 determines a "Yes" answer, causing the program to proceed to a simultaneous learning routine 91.

Assuming that the timer of computer 60 has finished measurement of the predetermined time during execution of the main control program at step 87, it is reset to restart measurement of the predetermined time, and simultaneously the computer 60 initiates execution of the first interruption control program at its step 100 shown in FIG. 11. When the first interruption control program proceeds to step 101, the computer 60 determines a "No" answer because of the count value Ct=0<a maximum count value Ctm. Thus, at the following step 102, the computer 60 renews the count value Ct by increment of "1" thereto to end the first interruption control program at step 103. In this embodiment, the maximum count value Ctm is determined to be larger than 200. Such execution of the first interruption control program will be repeated at each lapse of the predetermined time to repeat the renewal of the count value Ct at step 102. When the renewed count value Ct becomes equal to the maximum count value Ctm, the computer 60 determines a "Yes" answer at step 101, causing the program to proceed to the final step 103.

Thereafter, the computer 60 initiates execution of the simultaneous learning routine 91 as follows. When the program for the simultaneous learning routine proceeds to step 91a shown in FIG. 6, the computer 60 is initialized to cause the program to proceed to step 91b. At step 91b, the computer 60 adds the compensation value Af for feedback to the count value Ca (=0) and subtracts a constant Ka (=1) from the resultant value of the addition to renew the count value Ca as the resultant value of the subtraction. In this case, the constant Ka is determined as a compensation value for correcting the actual rotary step number S to the optimum rotary step number So without any feedback control. When the program proceeds to step 91c, the computer 60 determines a "No" answer because of the count value Ca≦Cm and causes the program to proceed to step 91d. At step 91d, the computer 60 determines a "No" answer because of the count value Ca≧0 and ends the program for the simultaneous learning routine at step 91g.

Figure 10:
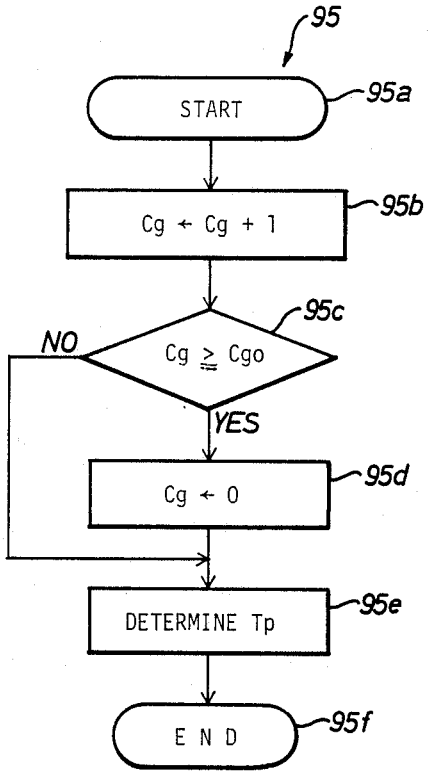
FIG. 10 is a flow chart illustrating a routine for calculation of simultaneous learning times shown in FIG. 5.

Subsequently, the computer 60 initiates execution of a routine 95 for calculation of the number of learning times shown in FIG. 10. When the program of the routine 95 proceeds to step 95a, the computer 60 causes the program to proceed to step 95b. At step 95b, the computer 60 renews the count value Cg (=0) by increment of "1" and causes the program to proceed to step 95c. At step 95c, the computer 60 determines a "No" answer because of the count value Cg<a maximum count value Cgo. When the program proceeds to step 95e, the computer 60 determines a learning time allowable value Tp in accordance with the newest count value Ct on a basis of an allowable data l representing a relationship between the learning time allowable value Tp and the count value Ct. (see FIG. 12) At the following step 95*f*, the computer 60 ends the execution of the routine 95 for calculation of the number of learning times. In this embodiment, the maximum count value Cgo is determined to be equal to the initial count value Tpo, and the allowable data l represents a limit for simultaneous learning times of the learning values G(1)–G(8). In other words, the allowable data l represents a maximum value of learning times of the respective learning values G(1)–G(8). In addition, the values of Cgo, Tp and $Tp_1$ are determined in the following relationship.

$$Cgo \geqq Tpo \geqq Tp_1 \geqq 0,\ Tpo \neq 0,\ Cgo/2 > Tp_1.$$

During repeat of the above execution at steps 83–87, 91*a*–91*d* and 91*g*, and 95*a*–95*c* and 95*e* after the execution of the routine 95, the computer 60 will determine a "Yes" answer at step 91*c* of the simultaneous learning routine 91. (see FIG. 6) In this instance, the program proceeds to step 91*e* where the computer 60 renews the newest count value Ca by subtraction of a standard count value Co therefrom and renews each of the learning values G(1)–G(8) by increment of "1" thereto. The standard count value Co is previously determined to be equal to half of a maximum value Cm and to correspond with the stoichiometric air-fuel ratio. When the computer 60 determines a "No" answer at step 91*c* and determines a "Yes" answer at the following step 91*d*, the program proceeds to step 91*f*. At step 91*f*, the computer 60 renews the newest count value Ca by addition of the standard count value Co thereto and renews each of the learning values G(1)–G(8) by subtraction of "1" therefrom.

Figure 12:
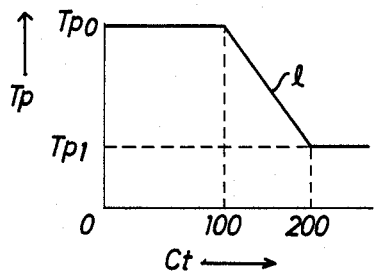
FIG. 12 is a graph representing data for simultaneous learning times in relation to lapse of time.

After repeat of the above execution at steps 91*c*–91*d*–91*g*, 91*c*–91*e*–91*g* or 91*c*–91*d*–91*f*–91*g*, the count value Cg becomes equal to the learning time allowable value Tp. Then, the computer 60 will determine a "No" answer at step 87, causing the program to proceed to step 88. In such a condition, as shown in FIG. 12, the learning time allowable value Tp decreases to a minimum allowable value $Tp_1$ in accordance with increase of the count value Ct. This means that the limit for simultaneous learning times of the whole learing values G(1)–G(8) decreases in accordance with lapse of time. Assuming that at step 88 of the program, the calculated amount of air Q is in the first air amount region ($0 \leqq Q < Q_1$), the computer 60 determines a "Yes" answer, causing the program to proceed to a learning routine 92 for the learning value G(1) shown in FIG. 7. In the learning routine 92, the computer 60 starts at step 92*a* to cause the program to proceed to step 92*b*. At step 92*b*, the computer 60 adds the feedback compensation value Af to the count value Cl (=0) and subtracts the constant Ka from the resultant value of the addition to renew the count value Cl as the resultant value of the subtraction. When the count value Cl is less than the maximum count value Cm or equal to zero, the computer 60 determines a "No" answer respectively at steps 92*c* and 92*d* to end the execution of the learning routine 92 at step 92*g*. Subsequently, the computer 60 renews the count value Cg at step 95*b* of the routine 95 and causes the program to proceed to step 83.

After repeat of the above execution at steps 83–88, 92*b*–92*d* and 92*g* and renewal of the count value Cg at step 95*b*, the computer 60 will determine a "Yes" answer at step 92*c*, causing the program to proceed to step 92*e*. At step 92*e*, the computer 60 renews the newest count value Cl by subtraction of the standard count value Co therefrom and renews the newest learning value G(1) by increment of "1" thereto. When the computer 60 determines a "No" answer at step 92*c* and determines a "Yes" answer at the following step 92*d*, the program proceeds to step 92*f*. At step 92*f*, the computer 60 renews the newest count value Cl by addition of the standard count value Co thereto and renews the newest learning value G(1) by subtraction of "1" therefrom. After repeat of the above execution at steps 92*c*–92*d*–92*g*, 92*c*–92*e*–92*g* or 92*c*–92*d*–92*f*–92*g*, the computer 60 will determine a "No" answer at step 88 in response to change of the calculated amount of air at step 83, causing the program to proceed to step 89.

Figure 8:
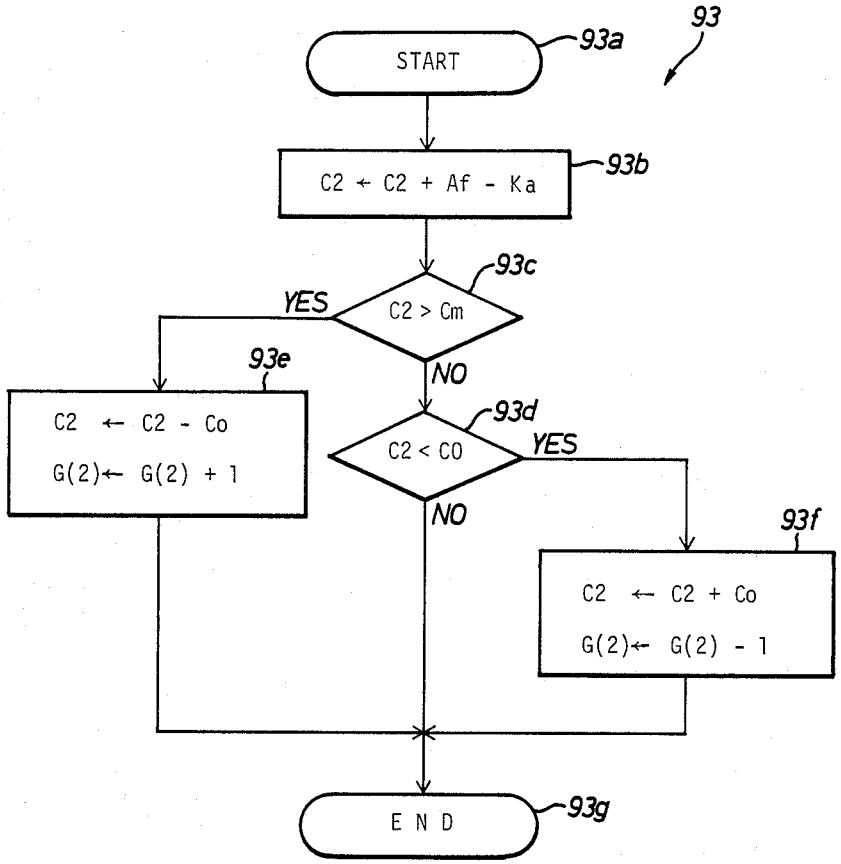
Figure 9:
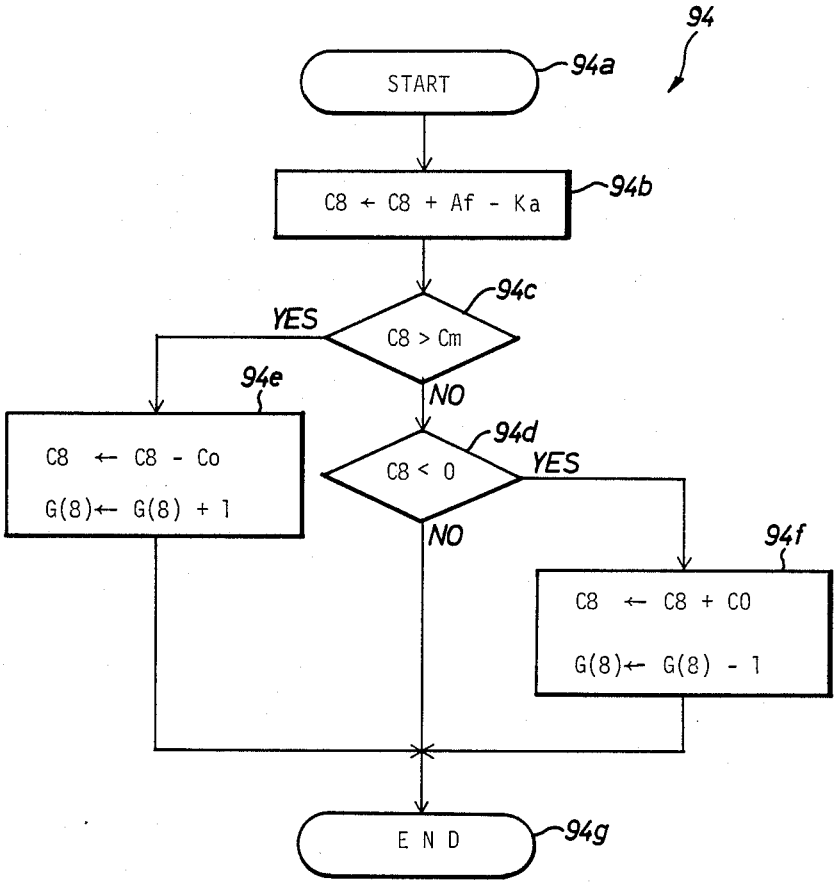

Assuming that at step 89 of the program, the calculated amount of air Q is in the second air amount region ($Q_1 \leqq Q < Q_2$), the computer 60 determines a "Yes" answer, causing the program to proceed to a learning routine 93 for the learning value G(2) shown in FIG. 8. In the learning routine 93, the computer 60 starts at step 93*a* to cause the program to proceed to step 93*b*. At step 93*b*, the computer 60 adds the feedback compensation value Af to the count value C2 (=0) and subtracts the constant Ka from the resultant value of the addition to renew the count value C2 as the resultant value of the subtraction. When the count value C2 is less than the maximum count value Cm or equal to zero, the computer 60 determines a "No" answer respectively at steps 93*c* and 93*d* to end the execution of the learning routine 93 at step 93*g*. Subsequently, the computer 60 renews the count value Cg at step 95*b* of the routine 95 and causes the program to proceed to step 83. After repeat of the execution at steps 83–89, 93*b*–93*d* and 93*g* and renewal of the count value Cg at step 95*b*, the computer 60 will determine a "Yes" answer at step 93*c*, causing the program to proceed to step 93*e*. At step 93*e*, the computer 60 renews the newest count value C2 by subtraction of the standard count value Co therefrom and renews the newest learning value G(2) by increment of "1" thereto. When the computer 60 determines a "No" answer at step 93*c* and determines a "Yes" answer at step 93*d*, the program proceeds to step 93*f* where the computer 60 renews the newest count value C2 by addition of the standard count value Co thereto and renews the newest learning value G(2) by subtraction of "1" therefrom.

After repeat of the above execution at steps 93*c*–93*d*–93*g*, 93*c*–93*e*–93*g* or 93*c*–93*d*–93*f*–93*g*, the computer 60 will determine a "No" answer at step 89 in response to change of the calculated amount of air at step 83, causing the program to proceed to the following steps. Subsequently, the computer 60 will selectively execute each learning routine (not shown) for the learning values G(3)–G(7) in accordance with change of the calculated amount of air Q at step 83. Assuming that at step 90 of the program, the calculated amount of air Q is in the eighth air amount region ($Q_7 \leqq Q < Q_8$), the computer 60 determines a "Yes" answer, causing the program to proceed to a learning routine 94 for the learning value G(8) shown in FIG. 9. In the learning routine 94, the computer 60 starts at step 94*a* to cause the program to proceed to step 94*b*. At step 94*b*, the computer 60 adds the feedback compensation value Af to the count value C8 (=0) and subtracts the constant Ka from the resultant value of the addition to renew the count value C8 as the resultant value of the subtraction. When the count value C8 is less than the maximum count value Cm or equal to zero, the computer 60 determines a "No" answer respectively at steps 94c and 94d to end the execution of the learning routine 94 at step 94g. Subsequently, the computer 60 renews the count value Cg at step 95b of the routine 95 and causes the program to proceed to step 83. After repeat of the execution at steps 83–90, 94b–94d and 94g and renewal of the count value Cg at step 95b, the computer 60 will determine a "Yes" answer at step 94c, causing the program to proceed to step 94e. At step 94e, the computer 60 renews the newest count value C8 by subtraction of the standard count value Co therefrom and renews the newest learning value G(8) by increment of "1" thereto. When the computer 60 determines a "No" answer at step 94c and determines a "Yes" answer at step 94d, the program proceeds to step 94f. At step 94f, the computer 60 renews the newest count value C8 by addition of the standard count value Co thereto and renews the newest learning value G(8) by subtraction of "1" therefrom. After repeat of the above execution at steps 94c–94d–94g, 94c–94e–94g or 94c–94d–94f–94g, the computer 60 will determine a "No" answer at step 90 in response to further change of calculated amount of air Q at step 83, causing the program to proceed to step 83 through the rountine 95. In addition, the count value Cg becomes equal to or larger than the maximum count value Cgo, and the computer 60 will reset the count value Cg to zero at step 95d of the routine 95.

As is understood from the above description, the control system is characterized in that the computer 60 is programmed to execute simultaneous learning of the whole learning values G(1)–G(8) in response to the determination of "Yes" at step 87 and to execute selective learning of the learning values G(1)–G(8) in response to the determination of "Yes" respectively at steps 88–90. This means that the simultaneous learning of the whole learning values G(1)–G(8) is repeatedly carried out at the respective allowable learning times determined in relation to lapse of time on a basis of the data shown in FIG. 12 and that the learning values G(1)–G(8) are selectively renewed in response to change of the calculated amount Q of air at step 83. As a result, even when the amount of air is frequently calculated at step 83 in a limited air amount region, all of the learning values G(1)–G(8) are uniformly and quickly renewed owing to the simultaneous learning to determine the optimum rotary step number So as precisely as possible. Additionally, when the engine 10 is restarted in a different condition, the previously renewed learning values G(1)–G(8) will be inappropriate for instant operation of the engine. In such a situation, the simultaneous learning of the learning values G(1)–G(8) is effective to ensure reliable determination of the optimum rotary step number So in a short time after restart of the engine.

Figure 13:
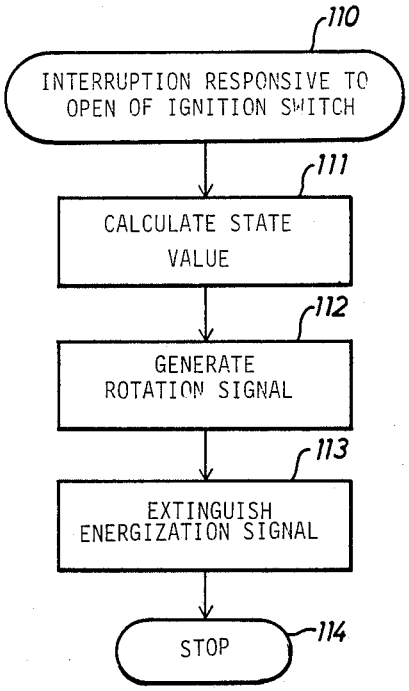
FIG. 13 is a flow chart illustrating a second interruption control program.

Assuming that the ignition switch IG is opened to stop the engine during arrest of the vehicle, the computer 60 is maintained in its activated condition by power supply across the switch 72 to execute the second interruption control routine shown in FIG. 13. In this intance, the computer 60 starts at step 110 to cause the program to proceed to step 111. At step 111, the computer 60 adds complement to the fresh learning value G(1) to memorize the resultant of the addition as a state value F. At step 112, the computer 60 produces a rotation signal for rotating the stepper motor 30a toward the initial position. Thus, the stepper motor 30a is activated by the rotation signal from computer 60 to displace the needle valve element 36 to the initial position. When the program proceeds to step 113, the computer 60 puts out the energization signal to deenergize the electromagnetic coil 71 so as to open the switch 72. Finally, the computer 60 stops the execution of the main control program at step 114. In such a condition, the back-up RAM of computer 60 is maintained in its activated condition by power supply from the back-up source 60a to memorize therein the newest learning values G(1)–G(8) and the state value F. In the carburetor 20, the auxiliary throttle piston 24 is returned to its maximum stroke end under the biasing force of compression spring 26.

Figure 5:
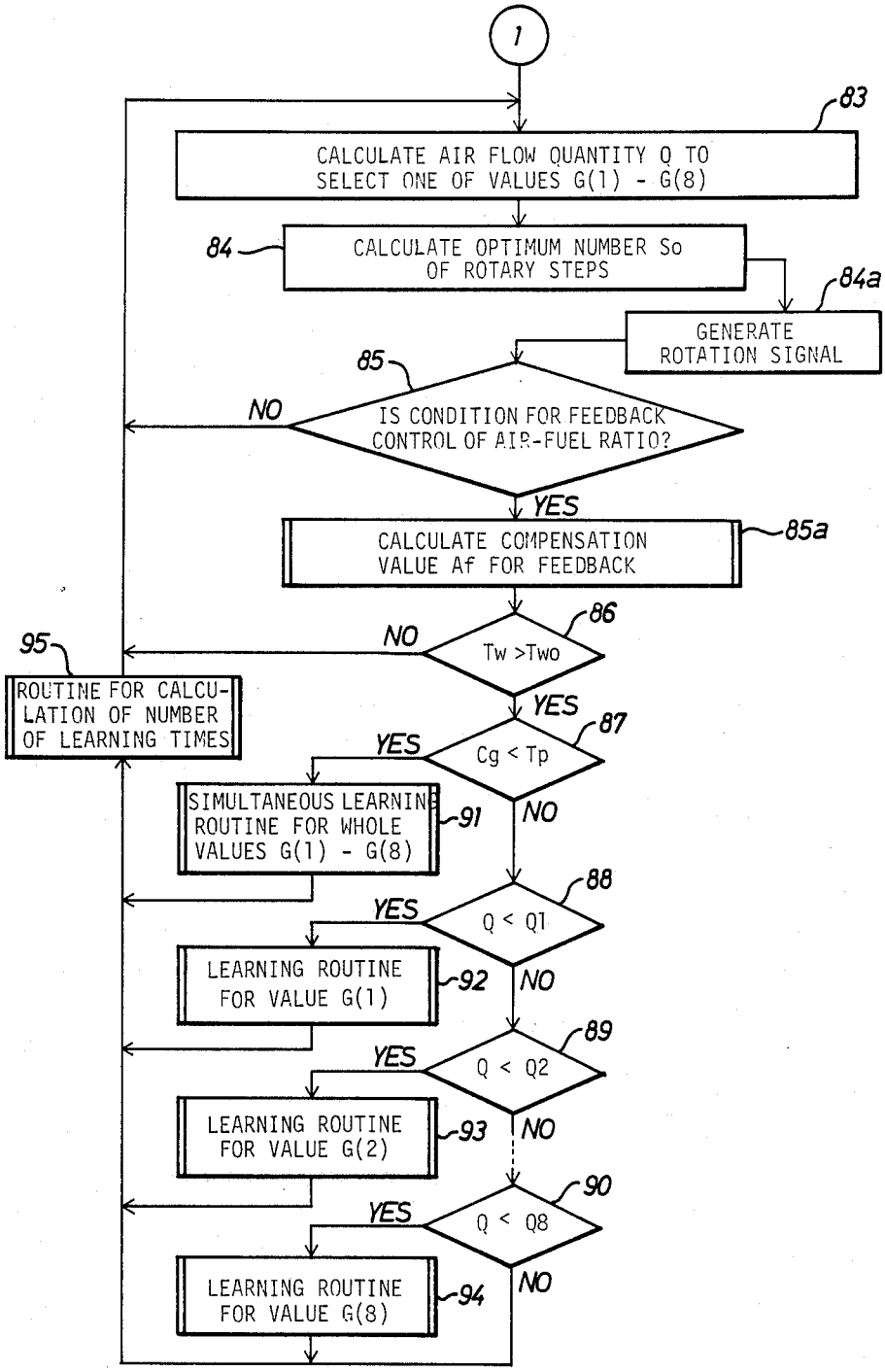
Figure 6:
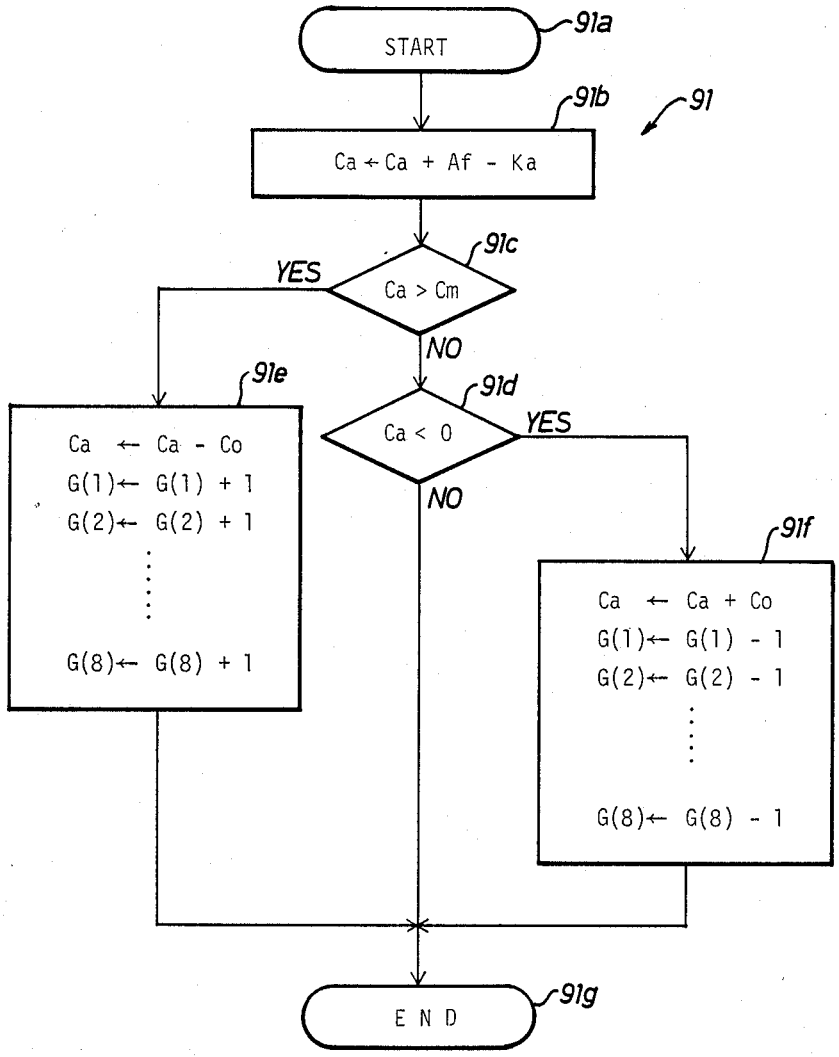
FIG. 6 is a flow chart illustrating a simultaneous learning routine for plural learning values shown in FIG. 5.
Figure 7:
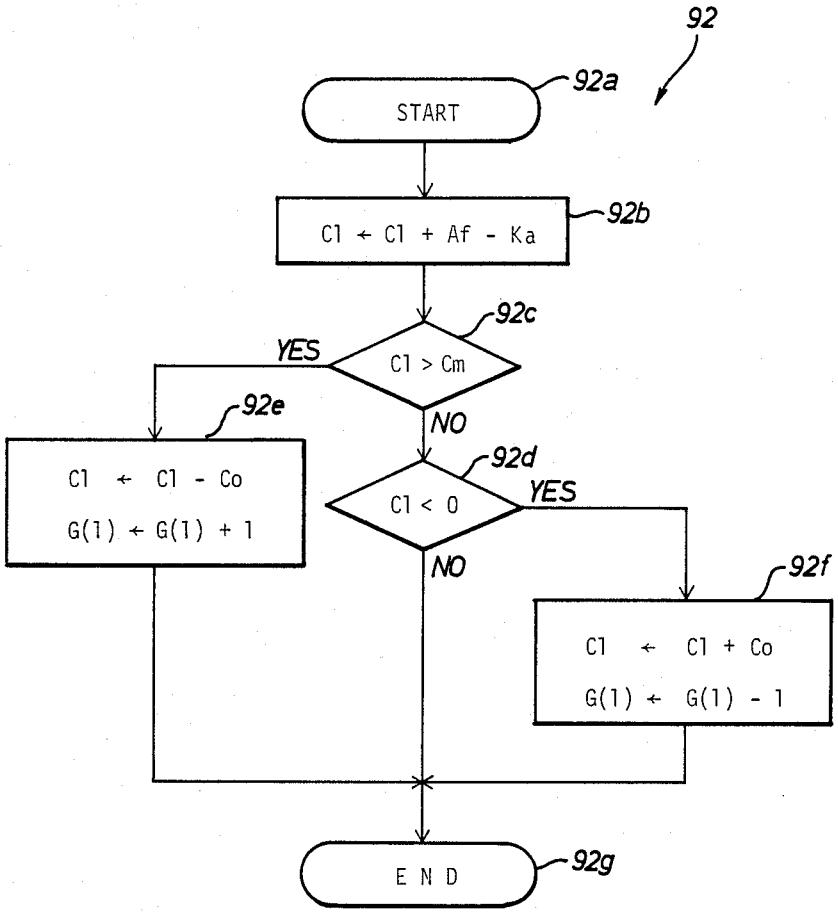
FIGS. 7–9 each illustrate a learning routine for the respective learning values shown in FIG. 5.
Figure 14:
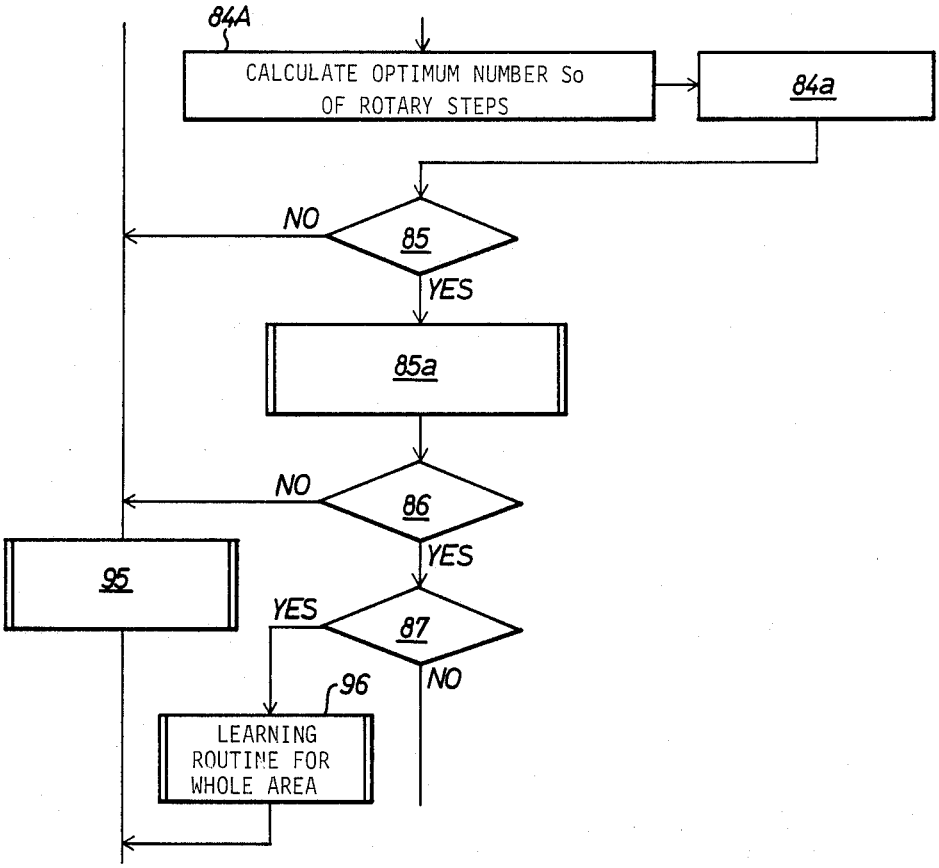
FIG. 14 is a flow chart illustrating a modification of the main control program shown in FIG. 5.
Figure 15:
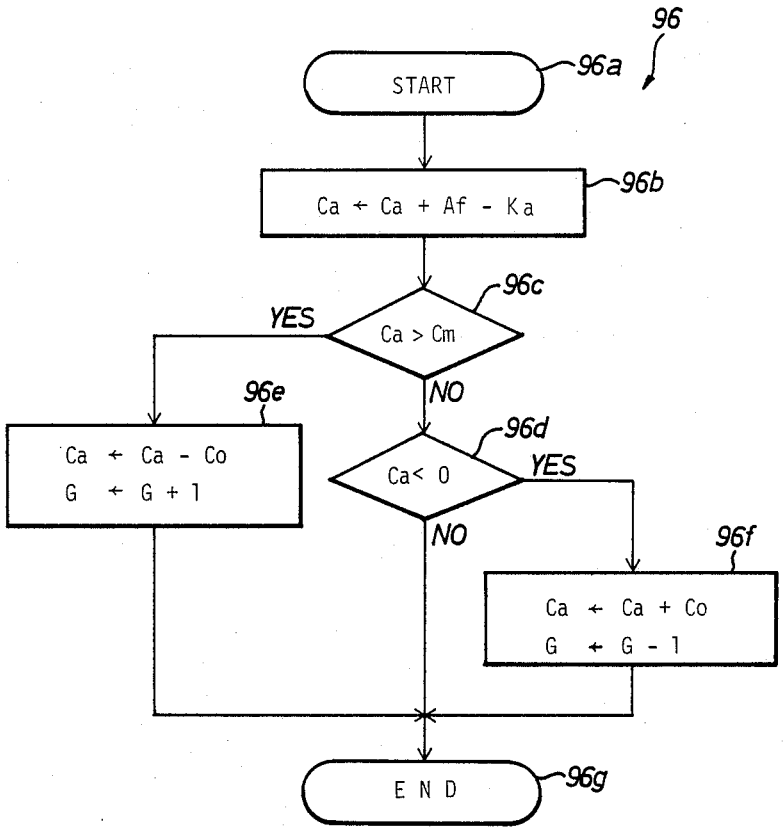
FIG. 15 is a flow chart illustrating a learning routine for whole area shown in FIG. 14.

In FIG. 14 there is illustrated a modification of the main control program of FIG. 5, wherein the simultaneous learning routine 91 for the whole learning values G(1)–G(8) is replaced with a learning routine for the whole area 96 which is illustrated in FIG. 15. Assuming that the computer 60 determines a "Yes" answer at step 87 of the main control program, the learning routine 96 will be executed as follows. At step 96a, the computer 60 starts to cause the program to proceed to step 96b. At step 96b, the computer 60 adds the feedback compensation value Af to the count value Ca and subtracts the constant Ka from the resultant value of the addition to renew the count value Ca as the resultant value of the subtraction. When the count value Ca is less than the maximum count value Cm or equal to zero, the computer 60 determines a "No" answer respectively at steps 96c and 96d to end the execution of the learning routine 96 at step 96g. Subsequently, the computer 60 renews the count value Cg at step 95b of the routine 95 and causes the program to proceed to step 83. After repeat of the above execution at steps 83–87, 96b–96d and 96g and renewal of the count value Cg at step 95b, the computer 60 will determine a "Yes" answer at step 96c, causing the program to proceed to step 96e. At step 96e, the computer 60 renews the newest count value Ca by subtraction of the standard count value Co and renews a common learing value G (=0) by increment of "1" thereto. When the computer 60 determines a "No" answer at step 96c and determines a "Yes" answer at step 96d the program proceeds to step 96f where the computer 60 renews the newest count value Ca by addition of the standard count value Co thereto and renews the common learning value G by subtraction of "1" therefrom. After repeat of the execution at steps 96c–96d–96g, 96c–96e–96g or 96c–96d–96f–96g, the computer 60 will determine a "No" answer at step 87, causing the program to proceed to step 88 of the main control program. Subsequently, the respective learning routines 92–94 for the learning values G(1)–G(8) are selectively executed in response to change of the calculated amount of air Q at step 83. In this case, each renewal of the learning values G(1)–G(8) is repeated on a basis of their initial values at step 81a or 81b, and the calculation of the optimum rotary step number So at step 84A is carried out on a basis of the following equation.

$$So = Sb + G + G(i) + Af + Aw + Aa + Ap \quad (3)$$

As is understood from the above description, the modification of the main control program is arranged to renew the common learning value G in response to the determination of "Yes" at step 87 and to selectively renew the learning values G(1)–G(8) in response to the determination of "Yes" at steps 88–90. This means that the learning of the common learning value G is repeatedly carried out at the respective allowable learning times determined in relation to lapse of time on a basis of the data shown in FIG. 12 and that the learning values G(1)–G(8) are selectively renewed in response to change of the calculated amount Q of air at step 83. As a result, even when the amount of air is frequently calculated at step 83 in a limited air amount region, each sum of the learning values G(1) and G, G(2) and G, . . . , G(8) and G is is quickly renewed owing to the learning of the common learning value G to determine the optimum rotary step number So as precisely as possible.

Although the foregoing embodiment and its modification has been adapted to a carburetor of the variable venturi type, the present invention may be adapted to a carburetor of the fixed venturi type. Furthermore, the present invention may be adapted to an electronic fuel injection system, wherein an optimum fuel injection time is determined on a basis of the foregoing equation (2) or (3). In the actual practice of the present invention, the main control program may be modified to alternatively carry out the simultaneous learning of the learning values G(1)–G(8) and the selective learning of the learning values G(1)–(8).

Having now fully set forth both structure and operation of preferred embodiments of the concept underlying the present invention, various other emodiments as well as certain variations and modifications of the embodiments herein shown and described will obviously occur to those skilled in the art upon becoming familiar with said underlying concept. It is, therefore, to be understood that within the scope of the appended claims, the invention may be practiced otherwise than as specifically set forth herein.

What is claimed is:

1. An electronic air-fuel mixture control system for an internal combustion engine, having an induction passage for conducting air-fuel mixture into said engine, fuel control means for controlling the amount of fuel metered into said air induction passage, and throttle means for controlling the amount of air flowing into said engine through said induction passage, the control system comprising:

first detecting means for producing a first signal indicative of the load acting on said engine;

second detecting means for producing a second signal indicative of the operating conditions of said engine;

first learning means for simultaneously learning a plurality of learning values related to a plurality of load regions of said engine;

second learning means responsive to said first signal for selectively learning said learning values in accordance with changes of the engine load;

means for repeatedly conducting the simultaneous learning of all said learning values at allowable learning times determined in relation to a lapse of time and for subsequently conducting the selective learning of said learning values after a finish of the simultaneous learning;

means responsive to said first signal for selecting one of said load regions in accordance with the engine load and for selecting one of said learning values related to the selected load region;

means responsive to said second signal for determining an amount of fuel for an optimum air-fuel ratio in accordance with the operating conditions of said engine and the selected learning value; and means for producing an output signal indicative of the determined amount of fuel and for applying said output signal to said fuel control means.

2. An electronic air-fuel mixture control system as claimed in claim 1, further comprising third detecting means for producing a third signal indicative of cooling water temperature of said engine, and means responsive to said third signal for permitting the simultaneous learning of said learning values and the selective learning of said learning values after the value of said third signal exceeds a temperature for warming up of said engine.

3. An electronic air-fuel mixture control system as claimed in claim 1, further comprising means for producing a third signal indicative of oxygen concentration in exhaust gases discharged from said engine, and wherein said first and second learning means are responsive to said third signal to renew said learning values in dependence upon change of the oxygen concentration.

4. An electronic air-fuel mixture control system for a carburetor adapted to an internal combustion engine, said carburetor including an induction passage with a venturi portion, a fuel passage supplying fuel from a float chamber into said venturi portion, an air bleed passage permitting the flow of air into said fuel passage to be mixed with the fuel, and air control means for controlling the amount of air flowing into said fuel passage through said air bleed passage, the control system comprising:

first detecting means for producing a first signal indicative of the load acting on said engine;

second detecting means for producing a second signal indicative of the operating conditions of said engine;

first learning means for simultaneously learning a plurality of learning values related to a plurality of load regions of said engine;

second learning means responsive to said first signal for selectively learning said learning values in accordance with changes of the engine load;

means for repeatedly conducting the simultaneous learning of all said learning values at allowable learning times determined in relation to a lapse of time and for subsequently conducting the selective learning of said learning values after a finish of the simultaneous learning;

means responsive to said first signal for selecting one of said load regions in accordance with the engine load and for selecting one of said learning values related to the selected load region;

means responsive to said second signal for determining an amount of air for an optimum air-fuel ratio in accordance with the operating conditions of said engine and the selected learning value; and means for producing an output signal indicative of the determined amount of air and for applying said output signal to said air control means.

5. An electronic air-fuel mixture control system for a carburetor adapted to an internal combustion engine, said carburetor including an induction passage with a venturi portion, a fuel passage supplying fuel from a float chamber into said venturi portion, an air bleed passage permitting the flow of air into said fuel passage to be mixed with the fuel, and air control means for controlling the amount of air flowing into said fuel passage through said air bleed passage, said control system comprising:

first detecting means for producing a first signal indicative of the amount of air flowing into said engine through said induction passage;

second detecting means for producing a second signal indicative of parameters of said engine including intake manifold pressure, air temperature, engine speed, cooling water temperature and oxygen concentration in exhaust gases;

first learning means for simultaneously learning a plurality of learning values related to a plurality of air amount regions in said induction passage;

second learning means responsive to said first signal for selectively learning said learning values in accordance with the amount of air flowing into said engine through said induction passage;

means for repeatedly conducting the simultaneous learning of all said learning values at allowable learning times determined in relation to a lapse of time and for subsequently conducting the selective learning of said learning values after a finish of the simultaneous learning;

means responsive to said first signal for selecting one of said air amount regions in accordance with the amount of air flowing into said engine and for selecting one of said learning values related to the selected air amount region;

means responsive to said second signal for determining an amount of air for an optimum air-fuel ratio in accordance with the parameters of said engine and the selected learning value; and means for producing an output signal indicative of the determined amount of air and for applying said output signal to said air control means.

6. An electronic air-fuel mixture control system for an internal combustion engine, having an induction passage for conducting air-fuel mixture into said engine, fuel control means for controlling the amount of fuel metered into said air induction passage, and throttle means for controlling the amount of air flowing into said engine through said induction passage, said control system comprising:

first detecting means for producing a first signal indicative of the load acting on said engine;

second detecting means for producing a second signal indicative of the operating conditions of said engine;

first learning means for learning a common learning value related to a plurality of load regions of said engine;

second learning means responsive to said first signal for selectively learning a plurality of learning values related to said load regions in accordance with changes of the engine load;

means for repeatedly conducting the learning of said common learning value at allowable learning times determined in relation to a lapse of time and for subsequently conducting the selective learning of said plural learning values after a finish of the repeatedly conducted learning;

means responsive to said first signal for selecting one of said load regions in accordance with the engine load and for selecting one of the said plural learning values related to the selected load region;

means responsive to said second signal for determining an amount of fuel for an optimum air-fuel ratio in accordance with the operating conditions of said engine and a sum of the selected learning value and said common learning value; and means for producing an output signal indicative of the determined amount of fuel and for applying said output signal to said fuel control means.

* * * * *